US011703267B2

(12) United States Patent
Rutkowski et al.

(10) Patent No.: US 11,703,267 B2
(45) Date of Patent: Jul. 18, 2023

(54) REFRIGERATOR APPLIANCE

(71) Applicant: WHIRLPOOL CORPORATION, Benton Harbor, MI (US)

(72) Inventors: Piotr Rutkowski, Wrocław (PL); Maurizio Valle, Varese (IT)

(73) Assignee: Whirlpool Corporation, Benton Harbor, MI (US)

( * ) Notice: Subject to any disclaimer, the term of this patent is extended or adjusted under 35 U.S.C. 154(b) by 157 days.

(21) Appl. No.: 17/373,109

(22) Filed: Jul. 12, 2021

(65) Prior Publication Data

US 2023/0009966 A1 Jan. 12, 2023

(51) Int. Cl.
*F25D 17/04* (2006.01)
*F25D 25/02* (2006.01)

(52) U.S. Cl.
CPC ..... *F25D 17/042* (2013.01); *F25D 25/025* (2013.01); *F25D 2317/0413* (2013.01); *F25D 2317/061* (2013.01); *F25D 2317/0672* (2013.01)

(58) Field of Classification Search
CPC ..... F25D 25/025; F25D 2317/0413; F25D 2317/061; F25D 2317/0672; F25D 2317/04111; F25D 2317/04131
See application file for complete search history.

(56) References Cited

U.S. PATENT DOCUMENTS

| | | | | |
|---|---|---|---|---|
| 4,557,118 | A | 12/1985 | Pink et al. | |
| 2006/0005567 | A1* | 1/2006 | Lee | F25D 25/021 62/408 |
| 2018/0265263 | A1* | 9/2018 | Li | B65D 43/0202 |
| 2019/0293342 | A1* | 9/2019 | Butenhoff | F25D 25/025 |

FOREIGN PATENT DOCUMENTS

| | | | | |
|---|---|---|---|---|
| CN | 1982820 | A | 6/2007 | |
| CN | 105546927 | A | 5/2016 | |
| CN | 105605866 | B | 5/2016 | |
| CN | 107131711 | B | 7/2019 | |
| CN | 111197897 | A | 5/2020 | |
| DE | 69719121 | T2 | 10/2003 | |
| DE | 102015222229 | A1 | 5/2017 | |
| DE | 102019214589 | A1 | 3/2021 | |
| DE | 102019214595 | A1 | 3/2021 | |
| DE | 102019214597 | A1 | 3/2021 | |
| KR | 970001442 | Y1 | 3/1997 | |
| KR | 20090133008 | A | 12/2009 | |
| WO | WO-2014154563 | A1 * | 10/2014 | A23B 7/152 |
| WO | 2019034371 | A1 | 2/2019 | |

OTHER PUBLICATIONS

WO-2014154563-A1 English Translation (Year: 2014).*

* cited by examiner

*Primary Examiner* — David J Teitelbaum

(74) *Attorney, Agent, or Firm* — Brooks Kushman P.C.

(57) ABSTRACT

A refrigerator includes a crisper drawer, a frame, and a cover plate. The frame is configured to receive the crisper drawer. The frame defines at least one orifice that is configured to vent air from the crisper drawer to an exterior of the crisper drawer to control a humidity within the crisper drawer. The cover plate is secured to the frame and is at least partially disposed over the at least one orifice. The cover plate is configured to pivot relative to the frame between a first position and a second position. The cover plate restricts air flow out of the crisper drawer in the first position. The cover plate facilitates air flow out of the crisper drawer in the second position.

18 Claims, 4 Drawing Sheets

REFRIGERATOR APPLIANCE

TECHNICAL FIELD

The present disclosure relates to an appliance such as a refrigerator.

BACKGROUND

In order to keep food fresh, a low temperature must be maintained within a refrigerator to reduce the reproduction rate of harmful bacteria. Refrigerators circulate refrigerant and change the refrigerant from a liquid state to a gas state by an evaporation process in order cool the air within the refrigerator. During the evaporation process, heat is transferred to the refrigerant. After evaporating, a compressor increases the pressure, and in turn, the temperature of the refrigerant. The gas refrigerant is then condensed into a liquid and the excess heat is rejected to the ambient surroundings. The process then repeats.

SUMMARY

A refrigerator includes a crisper drawer, a frame, and a cover plate. The frame is disposed about the crisper drawer. The frame defines at least one orifice that is configured to vent air from the crisper drawer to an exterior of the crisper drawer to control the humidity within the crisper drawer. The frame has a first protrusion extending therefrom that defines a plurality of scalloped notches. The frame has at least one pivot disposed between the at least one orifice and the first protrusion. The cover plate is secured to the pivot. The cover plate has a first region disposed over the at least one orifice and a second region disposed over the first protrusion. The cover plate has a second protrusion extending downward from the second region. The cover plate is configured transition between a closed position and an open position via rotation about the pivot. In the closed position the first region covers the at least one orifice to restrict air from flowing out of the crisper drawer and the second protrusion engages a first of scalloped notches to retain the cover plate in the closed position. In the open position a gap that is in fluid communication with the at least one orifice is defined between a distal end of the at least one orifice and the first region such that air flows from the crisper drawer to the exterior of the crisper drawer via the gap.

A refrigerator includes a crisper drawer, a frame, and a cover plate. The frame is configured to receive the crisper drawer. The frame or the crisper drawer defines at least one orifice that is configured to vent air from the crisper drawer to an exterior of the crisper drawer to control a humidity within the crisper drawer. The cover plate is secured to the frame or the crisper drawer and is at least partially disposed over the at least one orifice. The cover plate is configured to pivot relative to the frame or the crisper drawer between a first position and a second position. In the first position the cover plate is disposed over the at least one orifice to restrict air from flowing out of the crisper drawer. In the second position a gap that is in fluid communication with the at least one orifice is defined between a distal end of the at least one orifice and the cover plate such that air flows from the crisper drawer to the exterior of the crisper drawer via the gap.

A humidity control system for a refrigerator crisper drawer includes a frame and a cover plate. The frame is configured to receive the crisper drawer and defines at least one orifice that is configured to vent air from the crisper drawer to an exterior of the crisper drawer. The cover plate is pivotably secured to the frame. The cover plate is disposed over the at least one orifice. The cover plate defines a gap between an edge of the cover plate and a distal end of the at least one orifice. The gap establishes fluid communication between the at least one orifice and the exterior of the crisper drawer. The cover plate is configured to pivot relative to the frame from a first position to a second position to increase a size of the gap to facilitate air flow from the crisper drawer to the exterior of the crisper drawer. The cover plate is configured to pivot relative to frame from the second position to the first position to decrease the size of the gap to restrict air flow from the crisper drawer to the exterior of the crisper drawer.

DETAILED DESCRIPTION

Embodiments of the present disclosure are described herein. It is to be understood, however, that the disclosed embodiments are merely examples and other embodiments may take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the embodiments. As those of ordinary skill in the art will understand, various features illustrated and described with reference to any one of the figures may be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

Figure 1:
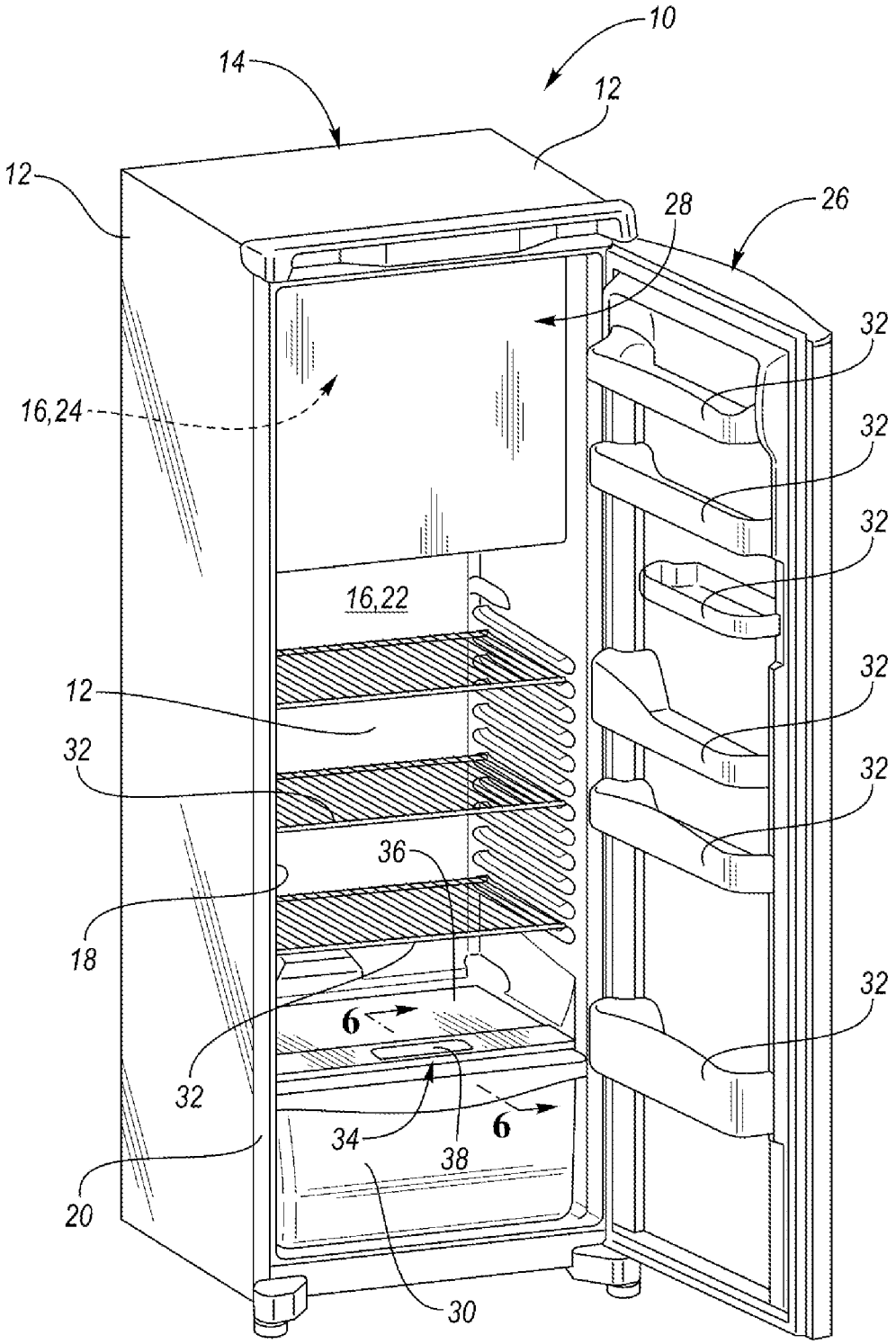
FIG. 1 is a front view of a refrigerator with the refrigerator door open.
Figure 2:
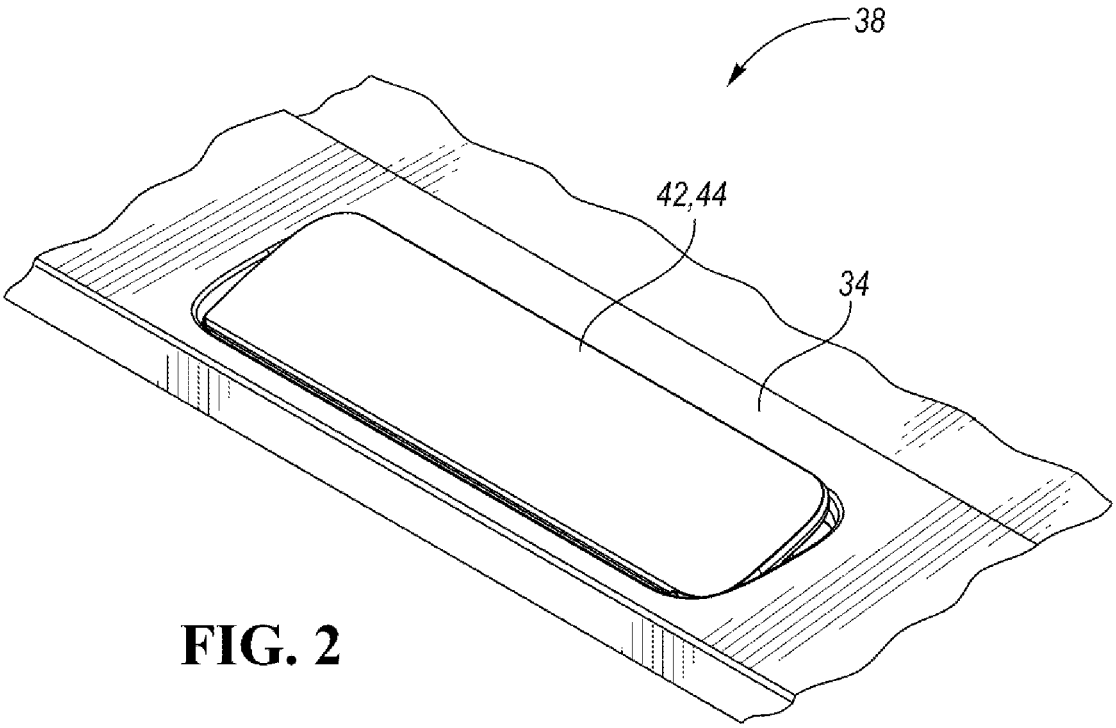
FIG. 2 is a top isometric view of a venting or humidity control system for a refrigerator crisper drawer with a cover plate of the humidity control system in a closed position.

Referring to FIG. 1, generally a refrigerator appliance 10 having a single door is illustrated. The refrigerator 10 has a plurality of walls 12 that form a housing 14. The walls 12 may include exterior panels and an internal liner. An insulating material, such as an insulating foam, may be disposed between the exterior panels and the internal liner of the walls 12 in order reduce the heat transfer from the ambient surroundings and increase the efficiency of the refrigerator. The walls 12 may include a rear or back wall, a top wall, a bottom wall, and two side walls. The plurality of walls 12 and the housing 14 define an internal cavity 16 and an opening 18 to the internal cavity 16. More specifically, a door frame 20 may define the opening 18 to access the internal cavity 16.

The internal cavity 16 may be divided into a first internal storage chamber or fresh food compartment 22 and a second internal storage chamber or freezer compartment 24. The first internal storage chamber, fresh food compartment, or refrigerator compartment 22 may be configured to refrigerate and not freeze consumables within the fresh food compartment 22. The second internal storage chamber or a freezer compartment 24 may be configured to freeze consumables within the freezer compartment 24 during normal use.

The single door 26 of refrigerator 10 provides access to the interior volume of the refrigerator 10 (i.e., the internal cavity 16) where consumables may be stored. The door 26 may be rotatably secured to the walls 12 by one or more hinges. A secondary door or freezer compartment door 28 may be disposed within the internal cavity 16 and over the freezer compartment 24 to provide a barrier between the freezer compartment 24 and the refrigerator compartment 22 within the internal cavity 16. A crisper drawer 30 may be disposed within the refrigerator compartment 22. The crisper drawer 30 may more specifically be a drawer defining a storage space that is kept at a desired humidity that may be different from the remainder of the refrigerator compartment 22, but that is optimal for maintaining freshness of fruits and vegetables. A frame 34 is configured to receive the crisper drawer 30. The crisper drawer 30 may be slidable into and out of the frame 34. When the crisper drawer 30 is within the frame 34, the frame 34 is disposed about or around the crisper drawer 30. An upper panel 36 that engages the frame 34 may be disposed along a top side of crisper drawer 30. The upper panel 36 may form part of the frame 34. The upper panel 36 may more specifically be a glass panel.

A venting or humidity control system 38 for the crisper drawer 30 is configured to vent air from the crisper drawer 30 to an exterior of the crisper drawer 30 (e.g., the portion of the internal cavity 16 that is outside of the crisper drawer 30) to control the humidity within the crisper drawer. The humidity control system 38 may be integrated into the frame as illustrated or may be integrated directly into the crisper drawer 30. One or more shelves 32 may be secured to the walls 12 within the refrigerator compartment 22 and to an internal surface of the door 26.

It is generally known that the freezer compartment 24 is typically kept at a temperature below the freezing point of water, and the refrigerator compartment 22 is typically kept at a temperature above the freezing point of water and generally below a temperature of from about 35° F. to about 50° F., and more typically below about 38° F.

The door 26 may include an exterior panel and an interior panel that is disposed on an internal side of the exterior panel of the door 26. The interior panel may be configured to face the internal cavity 16 when the door 26 is in a closed position. The interior panel of the door 26 may more specifically be a door liner. An insulating material, such as an insulating foam, may be disposed between the exterior panel and interior panel of the door 26 in order reduce the heat transfer from the ambient surroundings and increase the efficiency of the refrigerator 10.

The refrigerator 10 includes one or more refrigeration loops (not shown) that are configured to cool the air the within the refrigerator compartment 22 and the freezer compartment 24. The refrigeration loop includes at least a compressor, an evaporator that cools air being delivered to the refrigerator compartment 22 and/or the freezer compartment 24, a condenser that rejects heat to ambient surroundings, and a thermal expansion valve. Fans may be utilized to direct air across the evaporator and the condenser to facilitate exchanging heat. The compressor and the fans may be connected to a controller. Sensors that measure the air temperature within the refrigerator compartment 22 and the freezer compartment 24 may be in communication with the controller. The controller may be configured to operate the compressor, fans, etc. in response to the air temperature within the within the refrigerator compartment 22 and the freezer compartment 24 being less than a threshold.

Such a controller may be part of a larger control system and may be controlled by various other controllers throughout the refrigerator 10, and one or more other controllers can collectively be referred to as a "controller" that controls various functions of the refrigerator 10 in response to inputs or signals to control functions of the refrigerator 10. The controller may include a microprocessor or central processing unit (CPU) in communication with various types of computer readable storage devices or media. Computer readable storage devices or media may include volatile and nonvolatile storage in read-only memory (ROM), random-access memory (RAM), and keep-alive memory (KAM), for example. KAM is a persistent or non-volatile memory that may be used to store various operating variables while the CPU is powered down. Computer-readable storage devices or media may be implemented using any of a number of known memory devices such as PROMs (programmable read-only memory), EPROMs (electrically PROM), EEPROMs (electrically erasable PROM), flash memory, or any other electric, magnetic, optical, or combination memory devices capable of storing data, some of which represent executable instructions, used by the controller in controlling the refrigerator 10.

It should be understood that this disclosure should not be limited to the refrigerator configuration depicted in FIG. 1 but could apply to any type of refrigerator, such as a side-by-side type refrigerator, a two-door bottom mount type refrigerator, a top-mount type refrigerator, French-Door bottom mount type refrigerator, etc. Furthermore, it should be understood that the fresh food and freezer compartments may be accessible from the exterior of the refrigerator via separate doors.

Referring to FIGS. 2-7, the humidity control system 38 for the crisper drawer 30 is illustrated in Further detail. The frame 34 defines at least one orifice 40 that is configured to vent air from the crisper drawer 30 to the exterior of the crisper drawer 30 to control the humidity within the crisper drawer 30. In the illustrated embodiment, the frame 34 defines three orifices 40. However, it should be understood that the frame may define one or any number of orifices 40 that are configured to vent air from the crisper drawer 30 to the exterior of the crisper drawer 30. A cover plate 42 is pivotably secured to the frame 34 and is at least partially disposed over the at least one orifice 40. The cover plate 42 is configured to pivot relative to the frame 34 between a first or closed position 44 and a second or open position 46.

The cover plate 42 is disposed over the at least one orifice 40 to restrict air from flowing out of the crisper drawer 30 when the cover plate 42 is in the closed position 44. The at least one orifice 40 may have a proximal end 48 and a distal end 50. A gap 52 is defined between the distal end 50 of the at least one orifice 40 and the cover plate 42 such that air flows from the crisper drawer 30 to the exterior of the crisper drawer 30 via the gap 52 when the cover plate 42 is in the open position 46. More specifically, the gap 52 is in fluid communication with the at least one orifice 40 and establishes fluid communication between the at least one orifice 40 and the exterior of the crisper drawer 30 such that air flows from the crisper drawer 30 to the exterior of the crisper drawer 30 via the gap 52 when the cover plate 42 is in the open position 46. The gap 52 may be defined between an edge 54 of the cover plate 42 and the distal end 50 of the at least one orifice 40.

Figure 3:
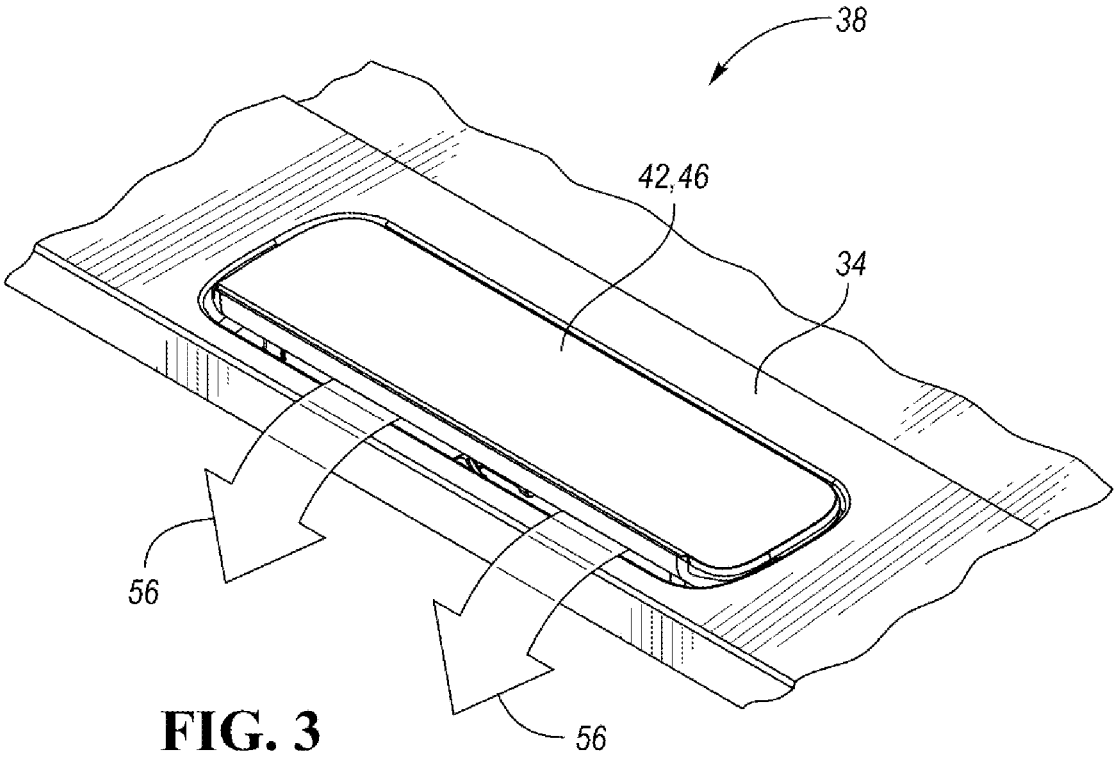
FIG. 3 is a top isometric view of the humidity control system with the cover plate of the humidity control system in an open position.
Figure 5:
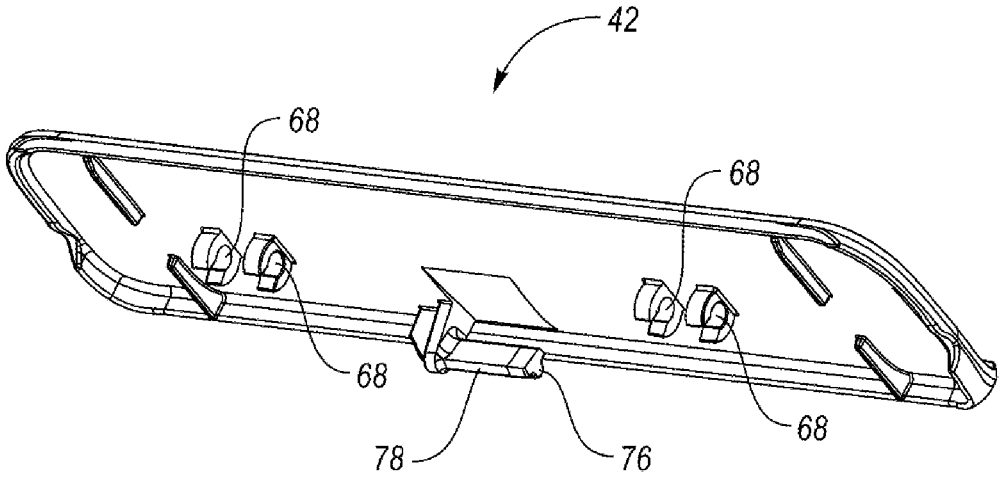
FIG. 5 is a bottom isometric view of the cover plate.
Figure 4:
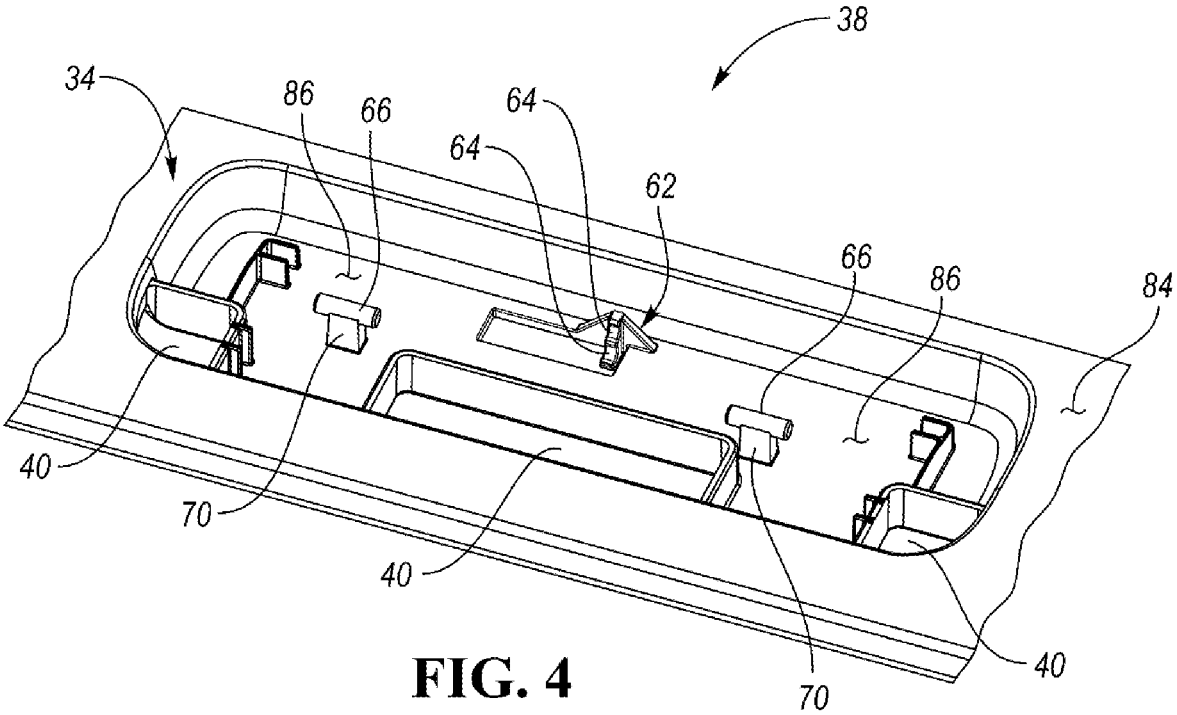
FIG. 4 is a top isometric view of the humidity control system with the cover plate of the humidity control system removed.
Figure 6:
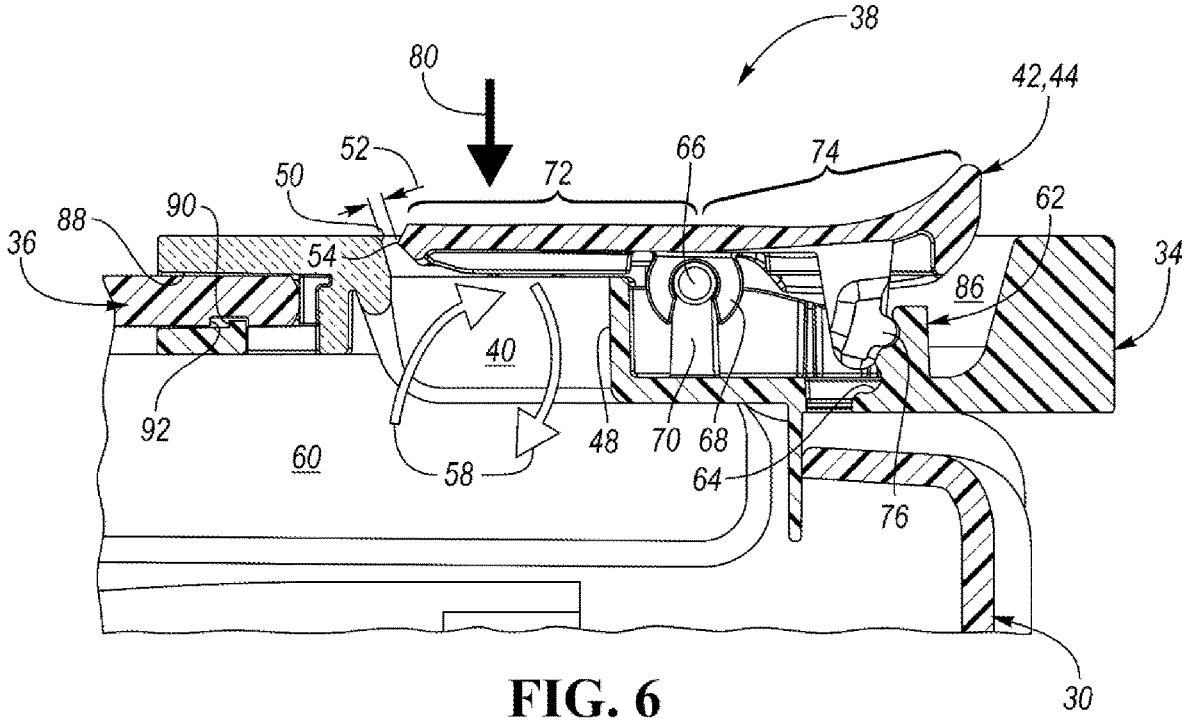
FIG. 6 is a cross-sectional view of a portion of the crisper drawer taken along line 6-6 in FIG. 1 with the cover plate of the humidity control system in the closed position.
Figure 7:
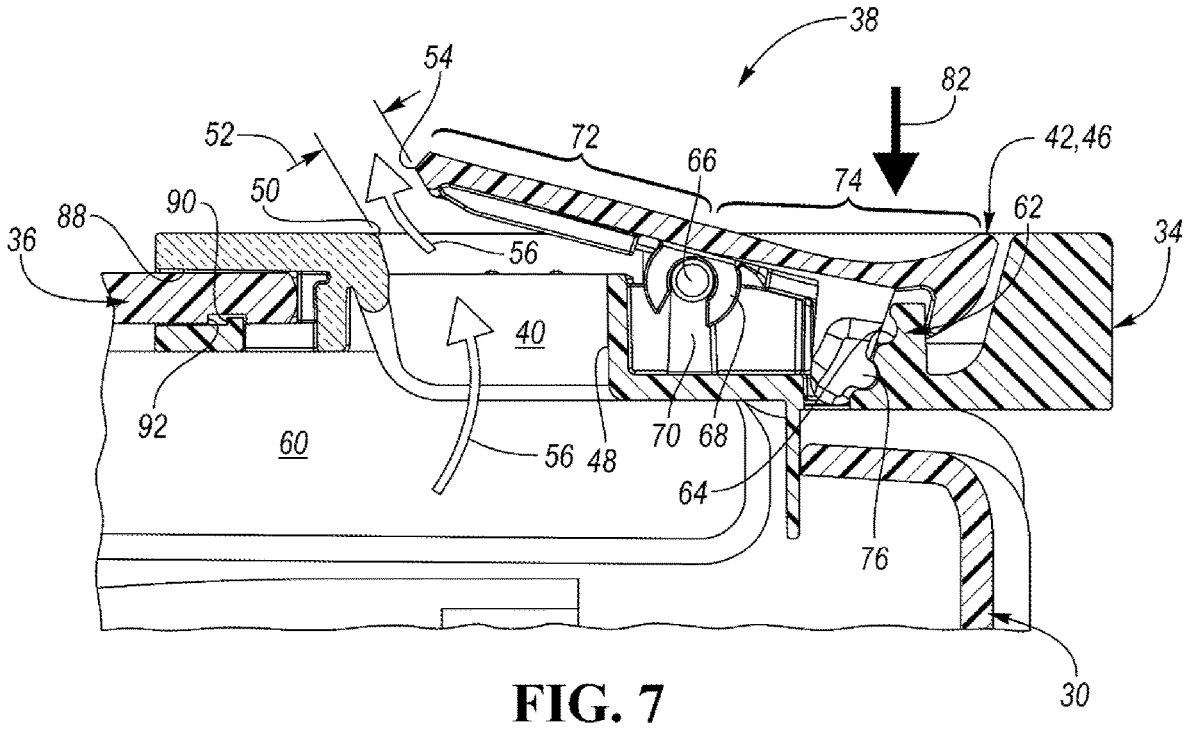
FIG. 7 is a cross-sectional view of the portion of the crisper drawer taken along line 6-6 in FIG. 1 with the cover plate of the humidity control system in the open position.

The gap 52 increases in size when the cover plate 42 is pivoted from the closed position 44 to the open position 46 to facilitate air flow from the crisper drawer 30 to the exterior of the crisper drawer 30, which is illustrated by arrows 56 in FIGS. 3 and 7. The gap 52 decreases in size when the cover plate 42 is pivoted from the open position 46 to the closed position 44 to restrict air flow from the crisper drawer 30 to the exterior of the crisper drawer 30, which is illustrated by arrow 58 in FIG. 6. More specifically, arrow 58 illustrates the airflow deflecting off of the cover plate 42 and being directed back into the internal space 60 defined within the crisper drawer 30. The gap 52 may be completely closed off in the closed position 44 or may have a significant decrease in size relative to the open position 46 such that air flow from the crisper drawer 30 to the exterior of the crisper drawer 30 is zero or negligible.

The frame 34 includes a first protrusion 62 extending therefrom that defines a plurality of scalloped notches 64. More specifically, the first protrusion 62 may extend upward from the frame 34. The frame also includes at least one pivot 66 disposed between the at least one orifice 40 and the first protrusion 62. The at least one pivot 66 may comprise at least one horizontally oriented post. In the illustrated embodiment, the frame 34 includes two pivots 66. However, it should be understood that the frame may include one or any number of pivots 66.

The cover plate 42 is pivotably or rotatably secured to the at least one pivot 66 and is configured to transition between the closed position 44 and the open position 46 via rotation about the at least one pivot 66. More specifically, the cover plate 42 may include at least one C-shaped bushing 68 that is disposed and configured to rotate about the at least one pivot 66. Even more specifically, two C-shaped bushings 68 may engage the horizontally oriented posts that form the pivots 66 on opposing sides of an upright 70 that connects the horizontally oriented posts to the frame 34. The C-shaped bushings 68 may be configured flex outward and snap back to form an engagement between at least one C-shaped bushings 68 and the horizontally oriented post during installation of the cover plate 42 onto the frame 34.

The cover plate 42 has a first region 72 that is disposed over the at least one orifice 40. The cover plate 42 also has a second region 74 that is disposed over the first protrusion 62. The cover plate 42 has a second protrusion 76 that extends from the second region 74. More specifically, the second protrusion 76 may extend downward from the cover plate 42 at the second region 74.

In the closed position 44, the first region 72 covers the at least one orifice 40 to restrict air from flowing out of the crisper drawer 30. The second protrusion engages 76 a first of the scalloped notches 64 to retain the cover plate 42 in the closed position. In the open position 46, the gap 52 is defined between the distal end 50 of the at least one orifice 40 and the first region 72 such that air flows from the crisper drawer 30 to the exterior of the crisper drawer via the gap 52. The second protrusion 76 engages a second of scalloped notches 64 to retain the cover plate 42 in the open position. As previously stated, the size of the gap 52 is increased in the open position 46 relative to the closed position 44. Also, as previously stated, the gap 52 may be completely closed off in the closed position 44 or may have a significant decrease in size relative to the open position 46 such that the air flow from the crisper drawer 30 to the exterior of the crisper drawer 30 is zero or negligible in the closed position 44.

The second protrusion 76 is secured to the cover plate 42 via a biasing element 78. The biasing element 78 is configured to force the second protrusion 76 into engagement with the scalloped notches 64. During a transition of the cover plate 42 from the open position 46 to the closed position 44, which occurs when a downward force is applied to the first region 72 (e.g., arrow 80 in FIG. 6), the second protrusion 72 engages the first protrusion 62 between the scalloped notches 64 causing the biasing element 78 to flex resulting in the second protrusion 72 being or forced out of the second of scalloped notches 64 and allowing the cover plate 42 to transition to the closed position 44. Once the cover plate 42 has reached the closed position 44, the biasing element 78 forces the second protrusion 72 into the first of the scalloped notches 64 to retain the cover plate 42 in the closed position 44.

During a transition of the cover plate 42 from the closed position 44 to the open position 46, which occurs when a downward force is applied to the second region 74 (e.g., arrow 82 in FIG. 7), the second protrusion 72 engages the first protrusion 62 between the scalloped notches 64 causing the biasing element 78 to flex resulting in the second protrusion 72 being or forced out of the first of scalloped notches 64 and allowing the cover plate 42 to transition to the open position 46. Once the cover plate 42 has reached the open position 46, the biasing element 78 forces the second protrusion 72 into the second of the scalloped notches 64 to retain the cover plate 42 in the open position 46.

A top surface 84 of the frame 34 may define a recessed region 86. The at least one orifice 40 may be defined within the recessed region 86. The first protrusion 62 may be disposed within the recessed region 86. The at least one pivot 66 may disposed within the recessed region 86. The cover plate 42 may be partially disposed within the recessed region 86 and may be partially disposed above the recessed region 86.

The frame 34 may define a slot 88 that is configured to receive an end of the upper panel 36. The frame 34 may include a protrusion 90 that extends into the slot 88. The upper panel 36 may define a grove 92. The protrusion 90 may engage the groove 92 to retain the end of the upper panel 36 within the slot 88.

In an alternative embodiment all aspects the humidity control system 38 may be defined by or connected to the crisper drawer 30 as opposed to the frame 34. For example, all the details illustrated in FIG. 4 may be defined by or connected to the crisper drawer 30 and the cover plate 42 may be connected to the crisper drawer 30.

It should be understood that the designations of first, second, third, fourth, etc. for any component, state, or condition described herein may be rearranged in the claims so that they are in chronological order with respect to the claims.

The words used in the specification are words of description rather than limitation, and it is understood that various changes may be made without departing from the spirit and scope of the disclosure. As previously described, the features of various embodiments may be combined to form further embodiments that may not be explicitly described or illustrated. While various embodiments could have been described as providing advantages or being preferred over other embodiments or prior art implementations with respect to one or more desired characteristics, those of ordinary skill in the art recognize that one or more features or characteristics may be compromised to achieve desired overall system attributes, which depend on the specific application and implementation. As such, embodiments described as less desirable than other embodiments or prior art implementations with respect to one or more characteristics are not outside the scope of the disclosure and may be desirable for particular applications.

What is claimed is:

1. A refrigerator comprising:

a crisper drawer;

a frame (i) disposed about the crisper drawer, (ii) defining at least one orifice that is configured to vent air from the crisper drawer to an exterior of the crisper drawer to control the humidity within the crisper drawer, (iii) having a first protrusion extending therefrom that defines a plurality of scalloped notches, and (iv) having at least one pivot disposed between the at least one orifice and the first protrusion; and a cover plate (i) secured to the pivot, (ii) having a first region disposed over the at least one orifice, (iii) having a second region disposed over the first protrusion, and (iv) having a second protrusion extending downward from the second region, wherein (i) the cover plate is configured transition between a closed position and an open position via rotation about the pivot, (ii) in the closed position the first region covers the at least one orifice to restrict air from flowing out of the crisper drawer and the second protrusion engages a first of scalloped notches to retain the cover plate in the closed position, and (iii) in the open position a gap that is in fluid communication with the at least one orifice is defined between a distal end of the at least one orifice and the first region such that air flows from the crisper drawer to the exterior of the crisper drawer via the gap and the second protrusion engages a second of scalloped notches to retain the cover plate in the open position.

2. The refrigerator of claim 1, wherein a top surface of the frame defines a recessed region, and wherein the at least one orifice is defined within the recessed region, the first protrusion is disposed within the recessed region, and the at least one pivot is disposed within the recessed region.

3. The refrigerator of claim 2, wherein the cover plate is partially disposed within the recessed region and is partially disposed above the recessed region.

4. The refrigerator of claim 1 further comprising a biasing element that bias the second protrusion into engagement with the scalloped notches.

5. The refrigerator of claim 1, wherein the at least one pivot comprises at least one horizontally oriented post.

6. The refrigerator of claim 5, wherein the cover plate includes at least one C-shaped bushing that is disposed and configured to rotate about the at least one horizontally oriented post.

7. The refrigerator of claim 6, wherein the at least one C-shaped bushing is configured flex outward and snap back to form an engagement between at least one C-shaped bushing and the at least one horizontally oriented post.

8. A refrigerator comprising:

a crisper drawer;

a frame configured to receive the crisper drawer, the frame or the crisper drawer defining at least one orifice that is configured to vent air from the crisper drawer to an exterior of the crisper drawer to control a humidity within the crisper drawer; and a cover plate secured to the frame or the crisper drawer and at least partially disposed over the at least one orifice, wherein (i) the cover plate is configured to pivot relative to the frame or the crisper drawer between a first position and a second position, (ii) in the first position the cover plate is disposed over the at least one orifice to restrict air from flowing out of the crisper drawer, and (iii) in the second position a gap that is in fluid communication with the at least one orifice is defined between a distal end of the at least one orifice and the cover plate such that air flows from the crisper drawer to the exterior of the crisper drawer via the gap, wherein (i) the frame or the crisper drawer has a first protrusion extending therefrom that defines a plurality of scalloped notches, (ii) the cover plate has a second protrusion extending downward therefrom, (iii) the second protrusion is configured to engage a first of scalloped notches to retain the cover plate in the first position, and (iv) the second protrusion is configured to engage a second of scalloped notches to retain the cover plate in the second position.

9. The refrigerator of claim 8 further comprising a biasing element that bias the second protrusion into engagement with the scalloped notches.

10. The refrigerator of claim 8, wherein first protrusion and the and the at least one orifice are disposed on opposing sides of a pivot point of the cover plate.

11. The refrigerator of claim 8, wherein the cover plate is pivotally secured to the frame or the crisper drawer via a C-shaped bushing that engages a horizontally oriented post.

12. The refrigerator of claim 11, wherein one of the C-shaped bushing and the horizontally oriented post is secured to the cover plate and the other of the C-shaped bushing and the horizontally oriented post is secured to the frame or the crisper drawer.

13. The refrigerator of claim 8, wherein a top surface of the frame or the crisper drawer defines a recessed region, and wherein the at least one orifice is defined within the recessed region.

14. The refrigerator of claim 13, wherein the cover plate is partially disposed within the recessed region and is partially disposed above the recessed region.

15. A humidity control system for a refrigerator crisper drawer comprising:

a frame configured to receive the crisper drawer and defining at least one orifice that is configured to vent air from the crisper drawer to an exterior of the crisper drawer; and a cover plate (i) pivotably secured to the frame, (ii) disposed over the at least one orifice, and (iii) defining a gap between an edge of the cover plate and a distal end of the at least one orifice, wherein (i) the gap establishes fluid communication between the at least one orifice and the exterior of the crisper drawer, (ii) the cover plate is configured to pivot relative to the frame from a first position to a second position to increase a size of the gap to facilitate air flow from the crisper drawer to the exterior of the crisper drawer, and (iii) the cover plate is configured to pivot relative to frame from the second position to the first position to decrease the size of the gap to restrict air flow from the crisper drawer to the exterior of the crisper drawer, wherein (i) the frame has a first protrusion extending therefrom that defines a plurality of scalloped notches, (ii) the cover plate has a second protrusion extending downward therefrom, (iii) the second protrusion is configured to engage a first of scalloped notches to retain the cover plate in the first position, and (iv) the second protrusion is configured to engage a second of scalloped notches to retain the cover plate in the second position.

16. The humidity control system of claim 15 further comprising a biasing element that bias the second protrusion into engagement with the scalloped notches.

17. The humidity control system of claim 15, wherein the cover plate is pivotally secured to the frame via a C-shaped bushing that engages a horizontally oriented post.

18. The humidity control system of claim 15, wherein a top surface of the frame defines a recessed region, and wherein (i) the at least one orifice is defined within the recessed region, (ii) the cover plate is partially disposed within the recessed region, and (iii) the cover plate is partially disposed above the recessed region.

* * * * *